US005884437A

United States Patent [19]

Olsen

[11] Patent Number: 5,884,437

[45] Date of Patent: Mar. 23, 1999

[54] NON RECTANGULAR BUILDING MODULES

[76] Inventor: Eric R. Olsen, 3132 Mt Kuebler Dr. S., Salem, Oreg. 97302

[21] Appl. No.: 772,938

[22] Filed: Dec. 24, 1996

[51] Int. Cl.[6] ..... E04H 3/00

[52] U.S. Cl. ..... 52/79.4; 52/79.7

[58] Field of Search ..... 52/745.02, 745.03, 52/79.1, 79.4, 79.7, 81.5

[56] References Cited

U.S. PATENT DOCUMENTS

| | | | |
|---|---|---|---|
| D. 191,438 | 10/1961 | Paulson | 52/79.4 X |
| 2,886,855 | 5/1959 | Petter | 52/79.4 |
| 3,395,502 | 8/1968 | Frey | 52/79.4 X |
| 3,566,554 | 3/1971 | Schaffer et al. | 52/79.7 X |
| 3,724,142 | 4/1973 | Worthington | 52/79.4 X |
| 3,785,096 | 1/1974 | Neuhardt | 52/79.4 |
| 3,791,080 | 2/1974 | Sjoberg | 52/79.4 |
| 3,851,427 | 12/1974 | Lacoste, III | 52/79.4 |
| 4,037,371 | 7/1977 | de la Lande de Calan | 52/79.7 X |
| 4,723,382 | 2/1988 | Lalvani | 52/79.4 |

*Primary Examiner*—Creighton Smith

[57] ABSTRACT

Improvement in or relating to the prefabrication and erection of building modules including substantially two basic modules: a trapezoidal module and a parallelogram module. Multiple combinations of modules create numerous building clusters that form whole structures that have flexibility of interior wall placement because bearing walls are located at the perimeter of the module. These load bearing walls are all parallel to one side of an equilateral triangle that is oriented on a horizontal plane. Each module contains two or three load bearing walls, and a roof section that spans across the volumes created.

18 Claims, 5 Drawing Sheets

NON RECTANGULAR BUILDING MODULES

BACKGROUND

This invention relates to an improved system of design and erection of buildings and specifically to modular buildings and modular building components.

PRIOR ART

The idea of prefabrication of building modules is not new. Though many improvements have been made since the popularization of modular construction, many problems still exist. Generally problems in modular building revolve around three construction concerns: appearance, cost, and versatility.

Considerable time and energy have been directed toward achieving functional designs that emphasize an appearance of angularity, that is, where the building footprint and room layouts are dominated by something other than 90 degree corners. A common response to this has been the creation of hexagonal units or modules. U.S. Pat. Nos. 2,886,855 (issued to B. J Petter, 1959); 3,152,366 (issued to McCrory, et al., 1964); 4,335,558 (issued to Caldwell and Dickson 1982); and 4,546,583 (issued to Hussar, 1985) are such attempts. Hexagonal modules found in these patents generally stand alone or combine multiple hexagons to create a honeycomb effect. While each one of these develops a sense of angularity, none succeed at achieving substantial versatility and/or reasonable cost savings over site construction. One disadvantage is the incorporation of building details, technologies, and construction methods that are not easily adapted to manufacturers that currently build pre-cut, panelized and modular buildings. Implementation of such systems requires substantial capitalization as a result of re-tooling and education. Also, building officials resist unfamiliar building systems. This leads to substantial delays, additional engineering, and more expense. This may not be the case after continued exposure in local markets, though more universal acceptance is difficult to achieve.

Other patents like U.S. Pat. No. 3,769,766 (issued to Speidel, 1973) and U.S. Pat. No. 4,295,307 (issued to Jensen, 1989) reduce the hexagon to a more basic building module: the equilateral triangle. While the aforementioned cost and versatility setbacks still exist, such schemes also introduce a further problem when using common building materials. Commonly sold rectangular floor and roof sheathings, for example, fit very awkwardly into a triangular module. Without using specialty materials, waste is a serious disadvantage. Some embodiments include the use of a preformed material like concrete as a remedy. The weight and difficulty in transportation of precast concrete modules can make this solution a less than favorable one. Up till now hexagonal and triangular building systems use interior supports, or supports that lie inside the structure's perimeter walls. This limits the flexibility of room placement. With the popularity of large open spaces in homes and offices, these designs can be cumbersome if not entirely impractical.

While not basically angular, manufactured or mobile homes are dominant in the current technology of prefabricated building modules. Much of their success rides on their basic building component, a rectangular box. They are able to achieve a great amount of repetition, and a reduction in cost, within the module itself. Specifically, floor joists, longitudinal beams, roof rafters, ridge beams exterior wall sections are generally repetitive in length and size from module to module and/or within each module. This fact coupled with the great efficiencies that accompany the manufacturing process explains why their costs can be so well controlled. All of this occurs, though, at the expense of creating a less architecturally interesting finished product as well as a building lacking in versatility.

Objects and Advantages: Several advantages of my invention are:

1) to provide repetitive building modules that reduce the cost of production;
2) to provide wall panels of identical length if desired;
3) to provide a repetitive floor structure whereby most joists are of identical length;
4) to provide repetitive roof structures whereby most load carrying members such as trusses are of identical length;
5) to avoid overly simplistic, bland structures often found in repetitious building systems;
6) to provide unlimited flexibility of interior wall placement because of lack of interior load bearing walls;
7) to provide no limit on quantity of modules that can be adjoined;
8) to provide angular living spaces;
9) provide a building system that favors exterior concrete wall construction;
10) to create a building system that allows the body of the house to change directions in the context of only two modules;
11) to provide a building system that is familiar and acceptable to building officials;
12) to provide a building system where most of the building can be erected on site as with panelized or precut construction and conversely allows for most of the erection to be done in a factory as with mobile home construction. Both methods can lead to structures that are less expensive than those that are conventionally framed building;

Still further objects and advantages will become apparent from a consideration of the ensuing description and drawing.

DESCRIPTION OF DRAWINGS

In the drawings, closely related figures have the same number but different alphabetic suffixes.

DESCRIPTION OF INVENTION

Figure 1A:
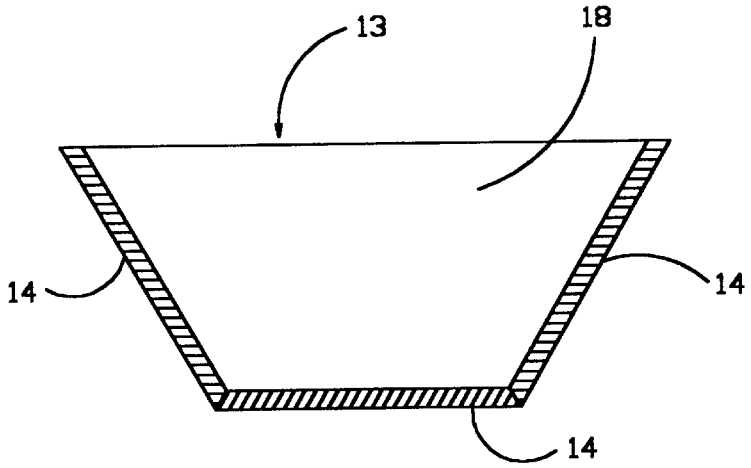
FIG. 1*a* shows a plan view of a trapezoidal module.
Figure 1B:
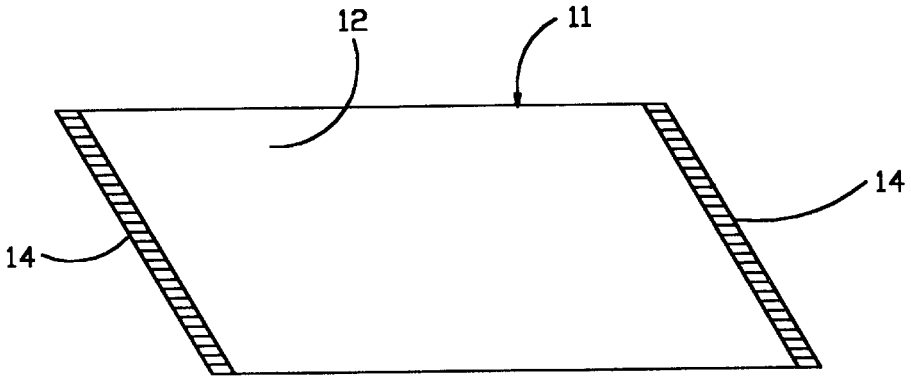
FIG. 1*b* shows a plan view of a parallelogram module.
Figure 1C:
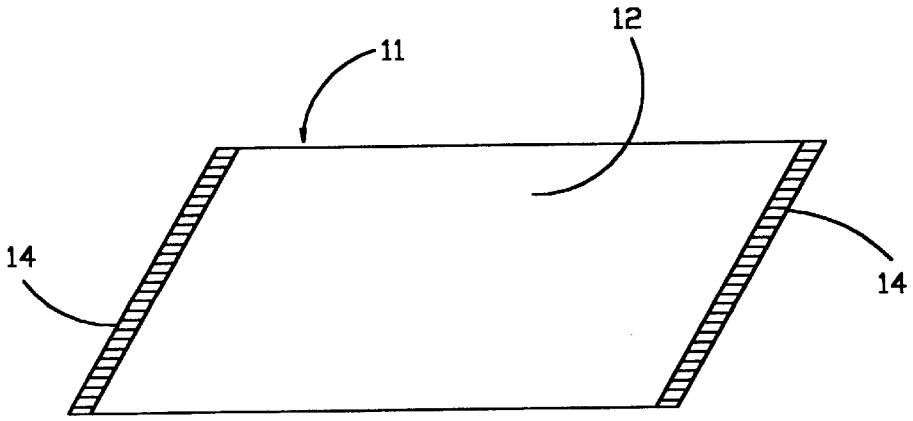
FIG. 1*c* shows a plan view of a parallelogram module with a reverse orientation of FIG. 1*b*.
Figure 2A:
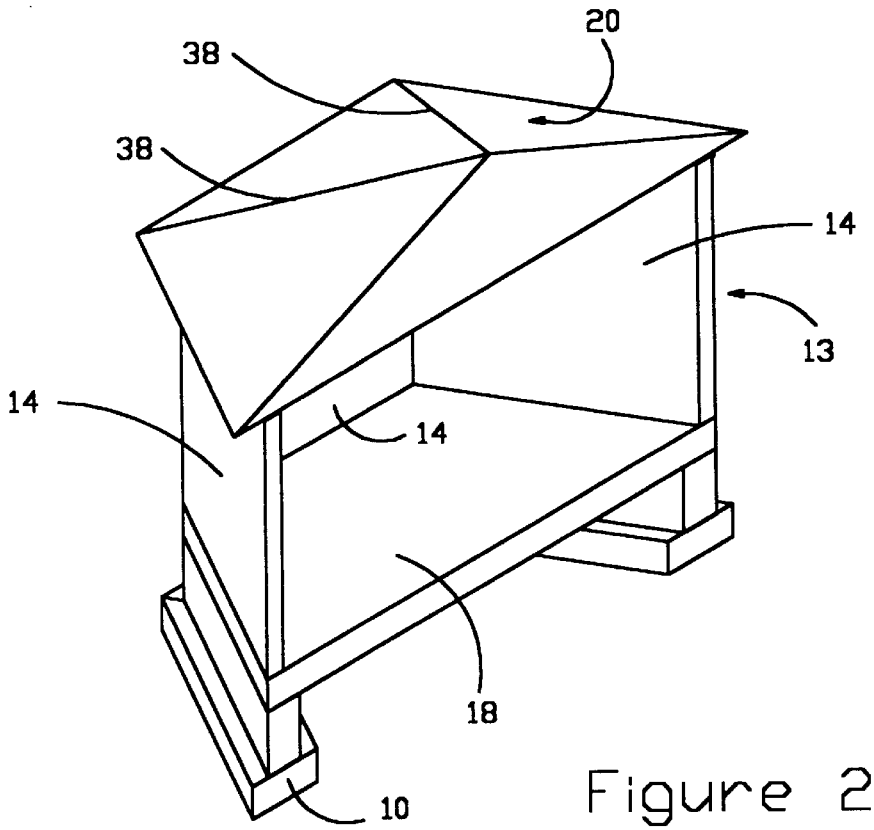
FIG. 2*a* shows a perspective view of a trapezoidal module.
Figure 2B:
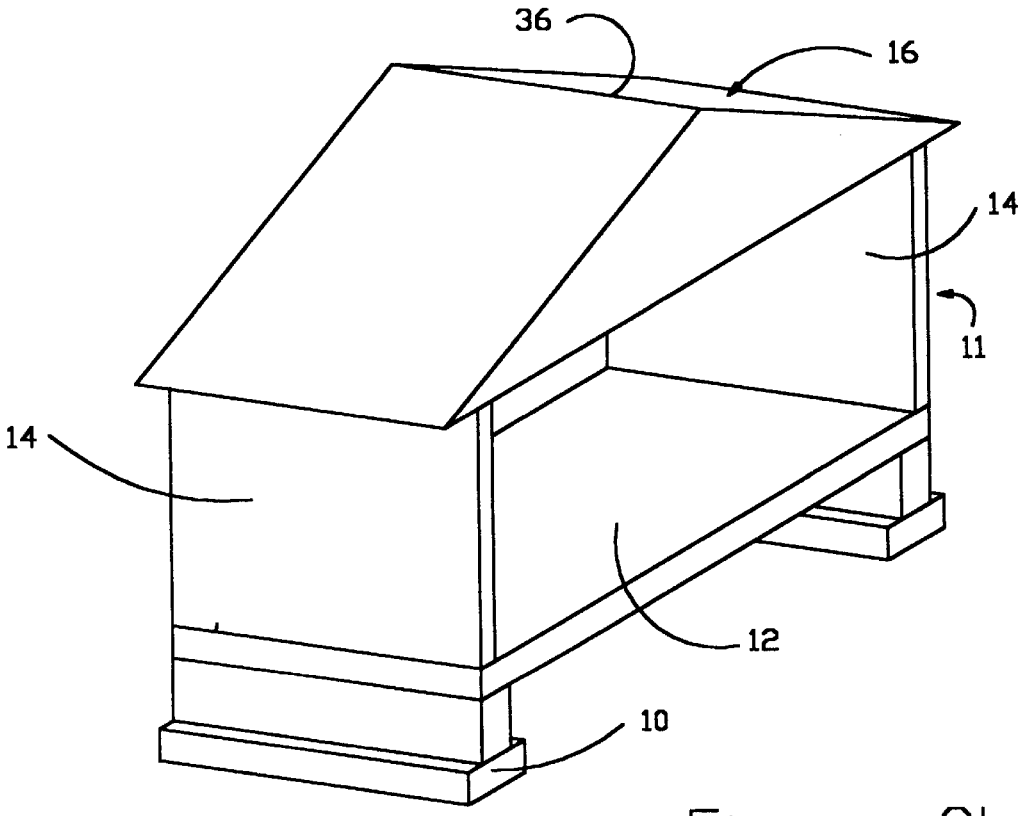
FIG. 2*b* shows a perspective view of a parallelogram module.

Referring now to various figures of the drawing that show one preferred embodiment of the invention, FIG. 2*a* and FIG. 2*b* indicate two building modules, a parallelogram module 11 and a trapezoid module 13, whereby a module is a convenient unit for transport; a repeated volume that has a repetitive structural system that can he erected at the building site or partially at the building site or away from the building site; a series of structural elements and/or assembly that repeat within a greater structural system and can be erected at the building site or partially at a building site or off the building site. A footing base 10 and floor bases 12 and 18 can take many forms and are not part of the present embodiment. Floor bases 12 and 18, and footing 10 in combination satisfy the following criteria: define the perimeter of modules 11 and 13, respectively, indicated on FIGS. 1*a*, 1*b* and 1*c*; withstand the vertical and lateral loads imparted to footing 10 and floor bases 12 and 18 upon use of the structure; provide a floor surface appropriate for the specified use of the structure. When modules are stacked a roof section 20 or 16 of a lower level module also serves as the floor base for the upper module. The resulting floor base for an upper module satisfies the same criteria as a more generic floor base 12 or 18, except it may not define the perimeter of the upper module. Only if the modules are vertically aligned will the roof section that acts as the floor base define the perimeter.

A trapezoid module 13, the plan of which is depicted in FIG. 1*a*, is defined by a trapezoid that has two interior acute angles each of 60 degrees and two interior obtuse angles of 120 degrees. Three wall panels 14 of equal length in combination with a fourth open side create the boundary of module 13. A parallelogram module 11 indicated in either FIG. 1*b* and FIG. 1*c* has two wall panels 14 that are positioned on the short sides of the parallelogram. The long sides, or open sides of this parallelogram are approximately twice the length of wall panel 14. Each interior obtuse angle is 120 degrees and each acute interior angle is 60 degrees. This creates the boundary of module 11.

Wall panel 14 is rectangular as implied in FIGS. 2*a* and 2*b*. Openings may be placed in wall panels 14 for windows, and doors—such an opening may be so extensive that wall panel 14 consists of a header beam that is supported by adjacent wall panels of adjacent modules. FIGS. 1*a*, 1*b* and 1*c* show how vertical edges are mitered to provide wall continuity when modules are placed adjacent to other modules to form building clusters. The construction of wall panels 14 can be of materials that create a rigid unit that can adequately carry the vertical and lateral loads imparted to the wall panel 14. Attachment of wall panels 14 to the footing base 10 or floor base 12 and 18 are accomplished through commercially available means as is connection of wall panels 14 to roof sections 16 or 20.

Figure 4:
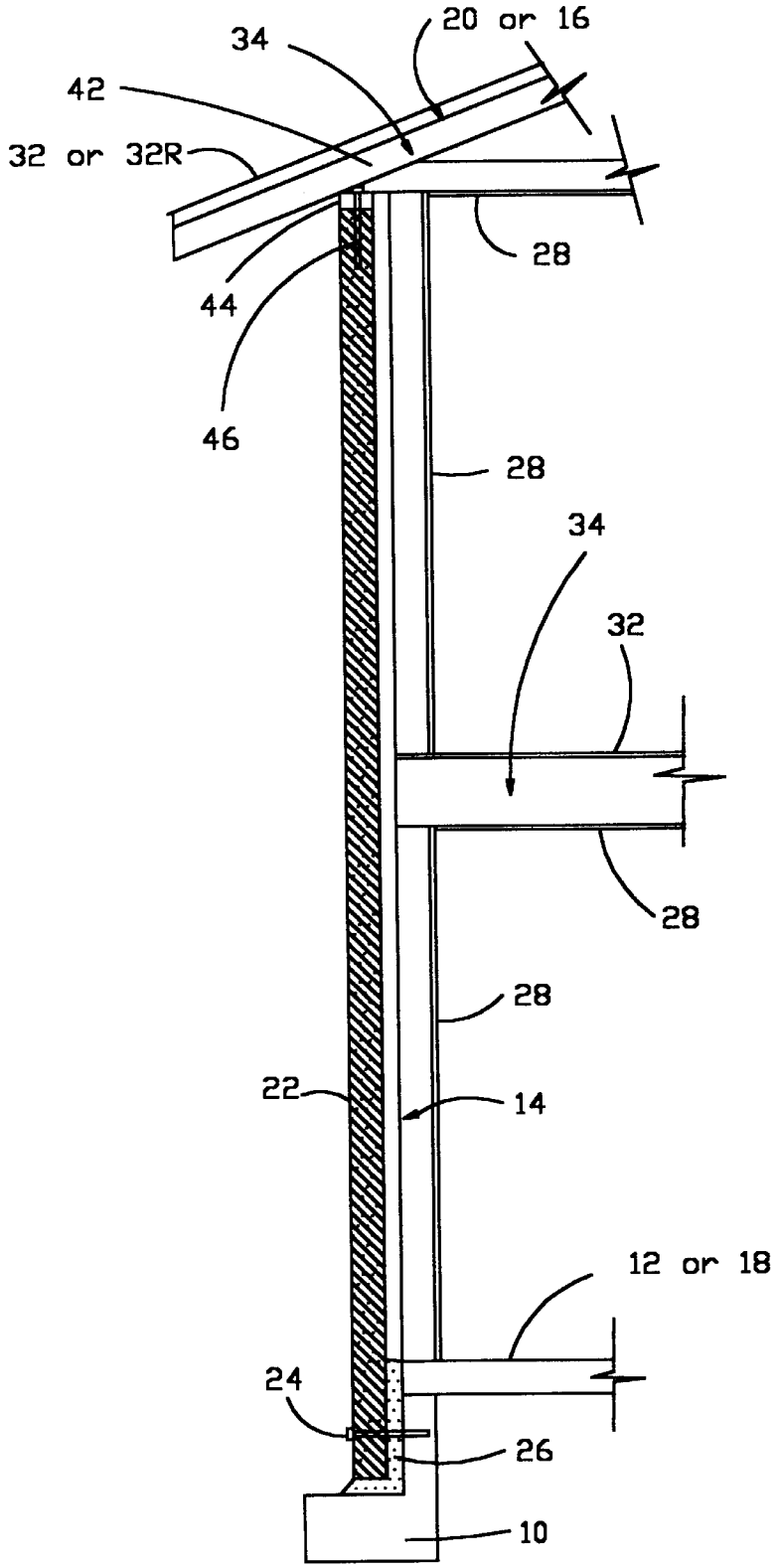
FIG. 4 shows a sectional view of a module where concrete clads the exterior of the structure.

Two preferred embodiment of wall panels 14 are: 1) conventional double skin stud construction utilizing wood or metal studs placed at regular intervals and attached to a conventional top and bottom plate. An exterior finish or siding and an interior finish 28 is then fastened to opposite faces of the studs. Insulating material, plumbing and electrical can be placed in the openings between the studs. 2) FIG. 4 shows another embodiment of wall panels 14. Footing base 10 is nearly centered under a reinforced concrete wythe 22, because the majority of vertical load originates from concrete wythe 22; this avoids eccentric loading. Footing 10 is L-shaped to create a concrete stemwall toward the interior of the structure that can support a floor base 12 or 18. Floor base 12 or 18 can be embodied as reinforced concrete slab on grade, or as a prefabricated parallelogram or trapezoid with geometry identical to the described boundaries of module 11 and 13. Concrete wythe 22 which is a component of wall panel 14 rests on a bed of cementuos non-shrinking grout 26. Grout 26 can be placed after concrete wythe 22 is located and resting on appropriate shimming material. A bolt 24 is drilled through concrete wythe 22 and into footing base 10 after concrete wythe has been set. Bolt 24 may consist of a threaded rod and nut with an epoxy adhesive that bonds concrete and grout to bolt 24. Concrete wythe 22 is reinforced with steel to the degree required to make it structurally sound. Connection of concrete wythe 22 to a roof section 20 or 16 is achieved through the use of a continuous wood plate or a top plate 44 at the top of concrete wythe 22. Attachment of top plate 44 to concrete wythe 22 relies on a bolt 46 embedded in the concrete and it recurs at specified spacing. The threaded portion of bolt 46 points upward and a nut and washer is used to tighten plate 44 against concrete wythe 22. Roof section 20 or 16 is then attached to top plate 44 in a manner familiar to those in the construction industry. The remainder of wall panel 14 is constructed as detailed in 1) except: concrete wythe 22 replaces the exterior finish; and the studs carry no vertical or lateral loads except that load generated by their own weight. Connection of concrete wythe 22 to an adjacent concrete wythe 22 occurs through continuity of the top plate 44 at the location where the vertical edges of wall panels 14 meet. Also footing 10 provides fixity at the base of these wythes and acts as a lower connection. Reinforced concrete wythe 22 is designed to span from these two connection points which provides stability for out of plane bending. Conventional caulking used in commercial and industrial tilt-up buildings provides a filler for a vertical joint that is approximately ½ inch wide.

Roof sections 16 and 20 may be pitched as indicated in FIG. 2*a* or 2*b* or flat in the case of stacked modules where a roof section acts as a floor for the module above as shown in FIG. 4. Roof section 16 follows the plan geometry of parallelograms illustrated in FIGS. 1*b* and 1*c* except for one dimensional difference. The long sides of roof section 16 may be longer than those of floor base 12 to allow for a roofoverhang. A similar overhang may also be preferred in roof section 20. An overhang is obtained by extending the longitudinal dimension of the open side of the trapezoid. This would allow for a roof to hang over two wall panels 14 that are adjacent to the open side. Continuance of the overhang at wall panel 14 that lies parallel to the open side module 13 is achieved at the site with conventional site framing.

Figure 5A:
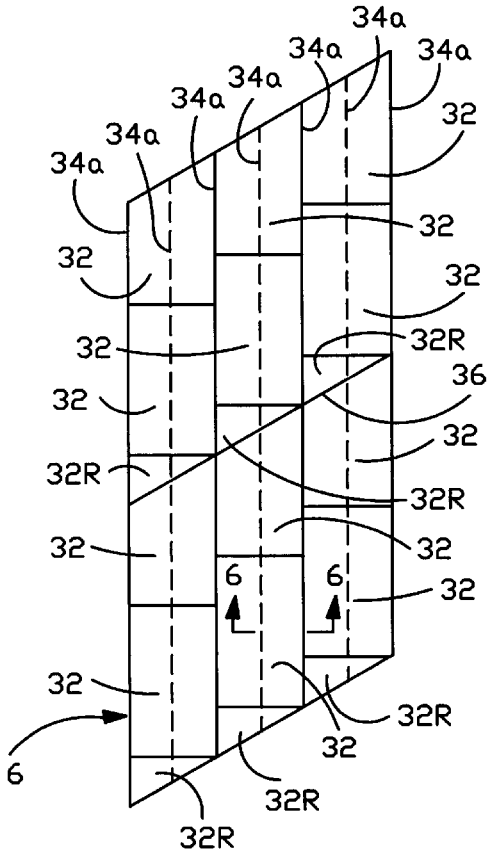
FIG. 5*a* shows a roof section framing plan of a parallelogram module

Roof section 16 transfers all vertical and lateral load to wall panels 14. As indicated in FIG. 5*a* the preferred embodiment of the roof section 16 consists of joists, trusses, or a roof load carrying members 34*a*, each of similar length, profile and design strength, spanning longitudinally, that is, parallel to the long side the parallelogram. A roof ridge 36 is only present when a roof section 16 is pitched as indicated in FIG. 2*b*.

As is common with wood framed construction, horizontal spacing of roof load carrying members 34*x* (where "x" indicates a letter from "a" to "g") is dictated by the amount of vertical load and the width or length of the a roof sheathing 32 or 32R. As shown in FIG. 5*a* roof sheathing 32 and roof sheathing 32R are oriented parallel to load carrying members 34 and the spacing between load carrying members 34*a* is a multiple of the width of roof sheathing 32 and 32R. For sake of description roof sheathing begins above wall panel 14—the short side that appears at the bottom of FIG. 5*a*. The starter course is a roof sheathing remnant 32R from a previous roof section 16 or 20. FIG. 5*a* shows how roof sheathing 32 is added in an upward direction in FIG. 5*a* until roof sheathing 32 passes over a roof ridge 36 and requires a cut at this planar intersection; a roof sheathing remnant 32R that results from such a cut is placed on the opposite side of roof ridge 36. Roof sheathing terminates above another wall panel 14. A new sheathing remnant 32R is formed from of a final cut made on roof sheathing 32. This new remnant 32R can be used in a future roof section 20 or 16. Roof load carrying members 34 are not oriented perpendicular to the roof ridge 36. FIG. 6, which is a section cut on FIGS. 5*a* and 5*b*, indicates how a truss top chord 42 is beveled in order to make a sound support for roof sheathing 32. Note that the angle of bevel varies depending on the slope of roof load carrying member 34.

Figure 5B:
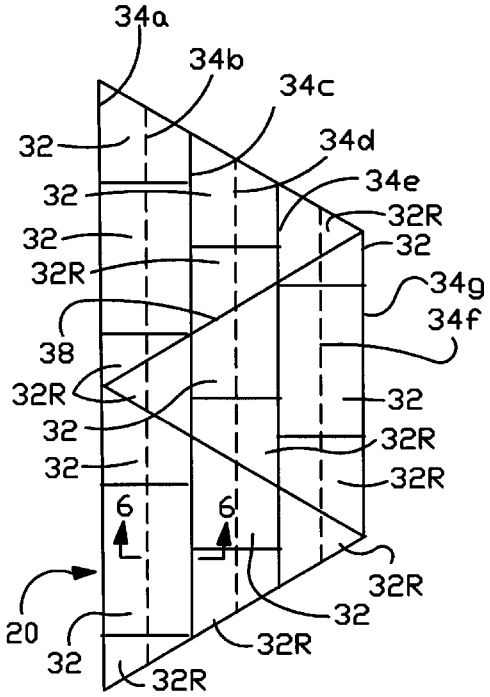
FIG. 5*b* shows a roof section framing plan of a trapezoidal module.
Figure 6:
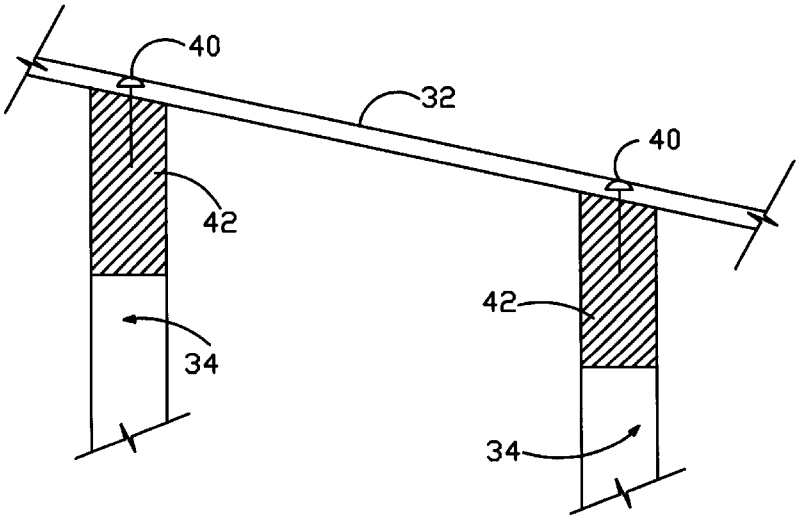
FIG. 6 shows a section through adjacent roof load carrying members.

FIG. 5*b* illustrates the preferred embodiment of framing for roof section 20. Roof section 20 transfers vertical and lateral load to wall panels 14. Load carrying members 34 are not of similar length and not of similar profile if roof section 20 is pitched as indicated in FIG. 2*a*. If no pitch is given to roof section 20, roof hips 38 are not present. Roof section 20 is supported by roof load carrying members 34*x* which span parallel to the open side of trapezoid module 13. As shown in FIG. 5*b* roof sheathing 32 is oriented parallel to load carrying members 34*x* and the spacing between load carrying members 34*x* is a multiple of the width of roof sheathing 32. Roof sheathing begins above wall panel 14 that lies adjacent to the open side of module 13. The starter course is a roof sheathing remnant 32R from a previous roof section. FIG. 5*b* shows how roof sheathing 32 is added until roof sheathing 32 passes over a roof hip 38 and requires a cut at this planar intersection; roof sheathing remnant 32R that results from such a cut is placed on the opposite side of roof hip 38. The required width of roof sheathing in the triangular area bounded by two roof hips 38 will vary slightly from roof sheathing not within these bounds. Roof sheathing terminates above another wall panel 14 that is also adjacent to the open side of module 13. A new sheathing remnant 32R is formed because of a final cut made on roof sheathing 32. This remnant can be used in a later roof section 16 or 20. FIG. 6 also indicates a support detail for roof sheathing 32 as discussed with reference to roof section 16.

Figure 3A:
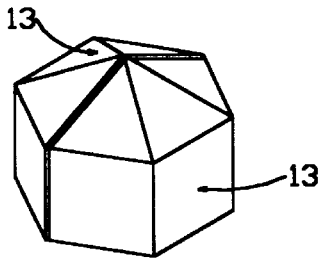
FIGS. 3*a ,b, c* show perspective views of module clusters of both one and two story configuration.
Figure 3B:
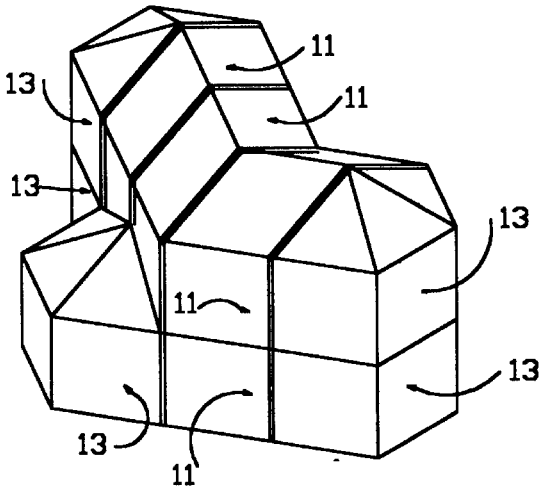
Figure 3C:
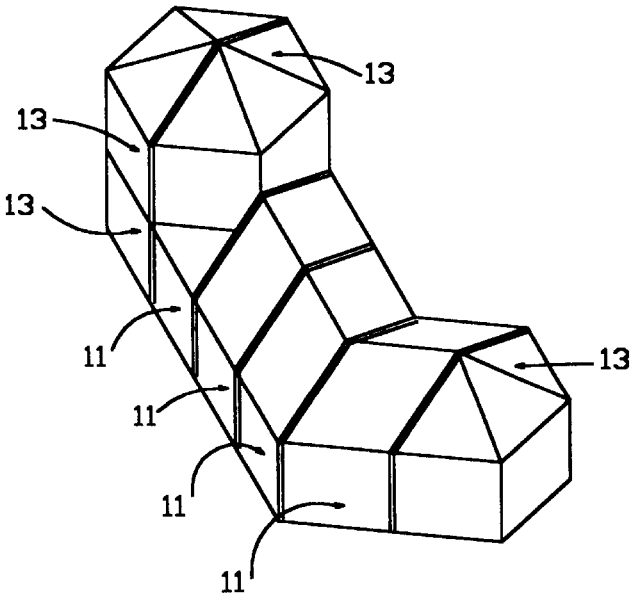

FIGS. 3*a*, 3*b*, and 3*c* show three examples of how trapezoidal modules 13 and parallelogram modules 11 may be combined to create building clusters. When combined horizontally, an open side of a specified module matches an open side of another specified module such that the vertical edges of two wall panels 14 from each specified module align with each other. Upon erection a series of wall panels 14 become an entire continuous wall. Where multi-story configurations are shown, the roof sections 16 and 20 of the lower module are generally flat to accommodate it as a floor for the upper module. Some designs may require that roof load carrying members 32 that carry floor load are supported at interior locations other than wall panels 14 if required to eliminate floor vibration, increase strength, or remedy other structural concerns. When trapezoidal modules 11 and 13 are stacked, all wall panels 14 are vertically aligned as indicated in FIG. 3*b*. However; FIG. 3*c* indicates one example of where only one wall panel 14 of a trapezoidal module 13 aligns vertically with one wall of parallelogram module 11 below. Roof section 16 must fulfill the requirement as a footing 10 and floor base 12 or 18 as indicated above; specifically, to support the load imparted to the roof section of parallelogram module 11 from wall panels 14.

Another embodiment includes floor base 12 or 18 as part of module 11 or 13 respectively so that this building system can be adapted to mobile home manufacturing and some types of panelized construction. Inclusion of floor bases allows for a more rigid assembly required if the module must be transported in an erected condition. The framing of floor bases 12 and 18 is similar to that for non pitched roof sections 16 and 20: floor joists span in a direction parallel to the open side or sides of module 11 or 13; sheathing layout is similar to roof sheathing 32 and 32R described in previous paragraphs and depicted in FIGS. 5*a* and 5*b*. Clear spans may not be necessary in this application because interior floor joist support have no impact on planning of interior space.

The present invention does not necessarily represent the extent of a finished structural shell. Design may dictate that additional site built structure or other complimentary prefabricated modules may be added to the present invention to augment the basic formulation of building modules.

SUMMARY, RAMIFICATIONS AND SCOPE

Accordingly, the reader of this patent will see that there is considerable repetition within the building components of this invention that makes it very suitable to prefabrication of part or all. This repetition manifests itself in not just the recurrence of trapezoidal and parallelogram modules but in considerable repetition of the components that make up these modules like roof load carrying member, floor joists and wall panels.

The unique method of construction allows for great flexibility of interior wall locations because of the ability to carry all loads on the exterior walls exclusively. Cumbersome interior columns and walls can be eliminated if desired.

Often structures that incorporate repetitive modules appear somewhat bland and unappealing. Because of the use of a triangular unit system that lays out all exterior walls on a triangular mesh the present invention avoids a noticeably modular appearance often accompanying more rectangular structures. Great flexibility in size of structure allows for lot size and affordability to be determining factors of design, not size limitations of the structure as is common with mobile homes.

Furthermore this building method has the additional advantages of:

1) Predominantly angular living spaces rarely found in modular construction. This building method allows for economical creation of rooms, living spaces, and other space divisions that are not basically rectangular as a design option.
2) Desireable use of concrete as a part of the exterior wall because repetition in precasting concrete is an essential part of achieving affordability.
3) Using familiar structural systems that building official can recognize allowing for expedition of building approval.
4) Simpler fabrication to accomodate transport via truck trailer or axles attached to the structure as commonly seen with mobile homes.

I claim:

1. A modular building system comprising:

A. a plurality of wall panels that are generally rectangular, each having an upper edge, a lower edge, and a vertical edge at each end;

B. a plurality of open sides, each said open side is generally a rectangular plane which is defined by a top, bottom, and said vertical edge on each end;

C. a parallelogram module that has a perimeter approximately defined by a parallelogram oriented on a horizontal plane, said parallelogram has two interior angles of approximately 60 degrees and two interior angles of approximately 120 degrees, said parallelogram module includes:

two said wall panels on opposite sides of said parallelogram;

two said open sides located on opposite sides of said parallelogram that do not contain the wall panels;

a parallelogram roof section that has a perimeter approximately defined by said parallelogram, said parallelogram roof section contains at least one load carrying member existing generally in a plane parallel to the open sides, said load carrying member spans to the wall panels, transferring vertical load;

means for attaching said parallelogram roof section to the wall panels' upper edge such that said parallelogram roof section is vertically aligned with said parallelogram;

D. A trapezoidal module that has a perimeter approximately defined by a trapezoid oriented on a horizontal plane, said trapezoid has two adjacent interior angle of 60 degrees and two adjacent interior angles of 120 degrees, said trapezoidal module includes:

three said wall panels located on each side of said trapezoid except the one side that has ends defined by two interior 60 degree angles;

one said open sides located on a side of said trapezoid that does not contain a wall panel;

a trapezoidal roof section that has a perimeter approximately defined by said trapezoid, and transfers vertical load to at least two of the wall panels in said trapezoidal module;

a means for attaching said trapezoidal roof section to the trapezoidal module wall panels which accept vertical load such that said trapezoidal roof section is vertically aligned with said trapezoid;

E. a means to attach at least one said trapezoidal module with at least one said parallelogram module such that said open side of said trapezoidal module coincides with one open side of said parallelogram module, whereby both coincidental open sides are approximately the same size.

2. The structure of claim 1 wherein sides of said parallelogram and said trapezoid that contain said wall panels are all of approximately the same length.

3. The structure of claim 2 wherein an exterior face of the wall panels are made of reinforced concrete and provides a means to erect a secondary wall on an interior face of said reinforced concrete wall panel with space for insulating said wall panels, and means for routing electrical and plumbing within the wall panel.

4. The structure of claim 1 further including a floor base in at least one of said building modules that is of similar perimeter as said parallelogram and said trapezoid, said floor base has floor joists that span from approximately one wall panel to another wall panel oriented parallel to said open side or sides, and means to attach said floor base to module.

5. The structure of claim 4 wherein said building module with floor base is preassembled and transported to a building site on a truck trailer.

6. The structure of claim 1 further including additional structure that acts in conjunction with a plurality of modules that makes a whole building larger than said cluster would be without such an addition.

7. The structure of claim 6 wherein said additional structure is built on site at the approximate time of erection of said building modules.

8. The structure of claim 1 wherein a building module is stacked on another similarly shaped building module wherein the wall panels of each module are vertically aligned and provide means for attaching the two stacked modules.

9. The structure of claim 1 wherein the wall panel is structurally supported by vertical wood studs that are placed at regular intervals, and connected to a horizontal top plate, and horizontal bottom plate.

10. A modular building system comprising:

A. a plurality of wall panels that are generally rectangular, each having an upper edge, a lower edge, and a vertical edge at each end;

B. a plurality of open sides, each said open side is generally a rectangular plane which is defined by a top, bottom, and said vertical edge on each end;

C. a parallelogram module that has a perimeter approximately defined by a parallelogram oriented on a horizontal plane, said parallelogram has two interior angles of approximately 60 degrees and two interior angles of approximately 120 degrees, said parallelogram module includes:

two said wall panels on opposite sides of said parallelogram;

two said open sides on opposite sides of said parallelogram that do not contain the wall panels;

a parallelogram roof section that has a perimeter approximately defined by said parallelogram, said parallelogram roof section contains at least one load carrying member existing generally in a plane parallel to the open sides, said load carrying member spans to the wall panels, transferring vertical load;

means for attaching said parallelogram roof section to the wall panels such that said parallelogram roof section is vertically aligned with said parallelogram;

E. a means to attach at least one said parallelogram module with another said parallelogram module with reversed orientation, such that one of said parallelogram module open sides coincides with one of said parallelogram module with reversed orientation open sides whereby the coinciding open sides are approximately the same size.

11. The structure of claim 10 wherein all sides of said parallelograms that contain said wall panels are all of approximately the same length.

12. The structure of claim 11 wherein an exterior face of the wall panels are made of reinforced concrete and provides a means to erect a secondary wall on an interior face of said reinforced concrete wall panel with space for insulating said wall panels, and means for routing electrical and plumbing within the wall panel.

13. The structure of claim 10 further including a floor base in at least one of said building modules that is of similar perimeter as said parallelogram, said floor base has floor joists that span from approximately one wall panel to another wall panel oriented parallel to said open side or sides, and means to attach said floor base to module.

14. The structure of claim 13 wherein said building module with floor base is preassembled and transported to a building site on a truck trailer.

15. The structure of claim 10 further including additional structure that acts in conjunction with a cluster of modules that makes a whole building larger than said cluster would be without such an addition.

16. The structure of claim 15 wherein said additional structure is built on site at the approximate time of erection of said building modules.

17. The structure of claim 10 wherein a building module is stacked on another similarly shaped building module wherein the wall panels of each module are vertically aligned and provide means for attaching the two stacked modules.

18. The structure of claim 10 wherein the wall panel is structurally supported by vertical wood studs that are placed at regular intervals, and connected to a horizontal top plate, and horizontal bottom plate.

* * * * *